United States Patent [19]

Rammelmeyr

[11] 4,415,400

[45] Nov. 15, 1983

[54] DEVICE FOR JOINING TWO SINGLE ADHESIVE TAPES TO FORM A DOUBLE ADHESIVE TAPE

[76] Inventor: Paul Rammelmeyr, Friedhofstr. 12, 8352 Grafenau, Fed. Rep. of Germany

[21] Appl. No.: 359,854

[22] Filed: Mar. 19, 1982

[30] Foreign Application Priority Data

Mar. 25, 1981 [DE] Fed. Rep. of Germany ..... 3111748

[51] Int. Cl.[3] ..... B32B 31/00

[52] U.S. Cl. ..... 156/555; 156/579

[58] Field of Search ..... 156/554, 555, 538, 574, 156/577, 523, 527, 530, 543, 544, 549–551

[56] References Cited

U.S. PATENT DOCUMENTS 2,012,014 8/1935 McCarthy ..... 156/554 X 3,395,061 7/1968 Covert etal. ..... 156/554 X

*Primary Examiner*—David A. Simmons

*Attorney, Agent, or Firm*—Cushman, Darby & Cushman

[57] ABSTRACT

An apparatus for joining two single adhesive tapes, each provided with an adhesive layer on one side, to form a double sided adhesive tape with two supports each rotatably mounting a tape roll on a frame in mutually corresponding radial planes. The tapes pass around tape controls where they are joined together.

12 Claims, 2 Drawing Figures

DEVICE FOR JOINING TWO SINGLE ADHESIVE TAPES TO FORM A DOUBLE ADHESIVE TAPE

Figure 1:
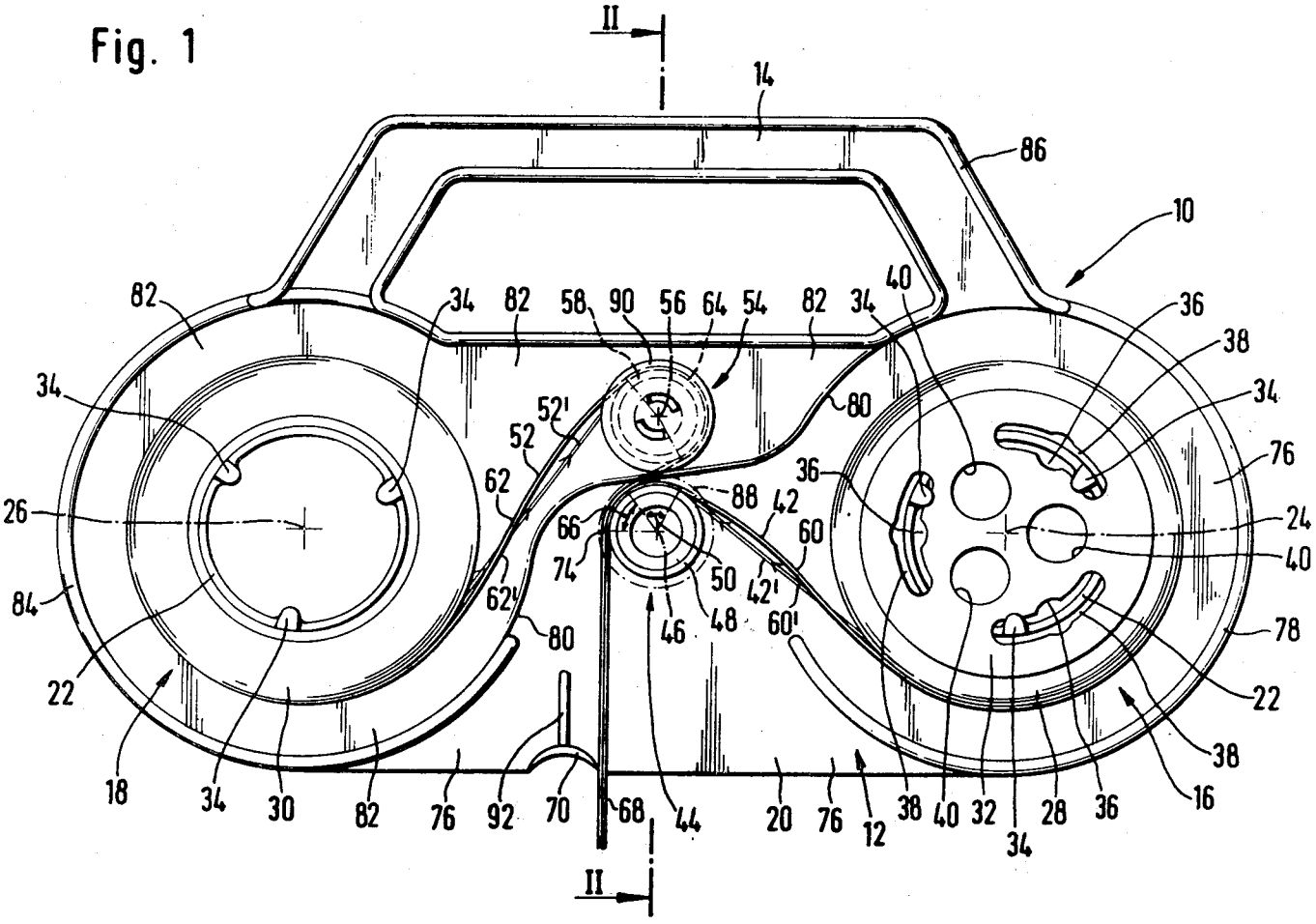

The invention relates to an apparatus for joining two single adhesive tapes, each provided with an adhesive layer on one side, to form a double sided adhesive tape.

Devices of this type have been known, for example, from German AS No. 22 07 944. However, the device described in that patent is large and quite cumbersome because of distancing and other rollers. The device is further disadvantageous because of the necessity of having to place the device on a solid support, as the inventor of this prior art device explains in a further application DE OS No. 25 01 586.

In order to produce a more compact device, a coaxial arrangement of single rollers is described in another application, German OS No. 25 01 586. The rollers are provided in a housing with an output slit, so that forcible joining by way of the joint output slit and possibly the guide rollers takes place. It is obvious that in the case of a slanting delivery of the adhesive tapes to the joint overlapping area at the output slit, lateral shearing forces occur which lead to an imprecise gluing and thus to a gluing with ribs. This occurs because the gluing forces, conditional on an originally slanting gluing together, have to be compensated continuously by the subsequently acting gluing forces of the oblique gluing.

The result is that, with double sided tapes, for use in painting, colors are drawn through the groove and rib areas directly or through capillary action onto the surface that is to be covered. This double sided adhesive tape is stuck with one of its adhesive sides in the customary manner to a surface to be covered, while the still free adhesive surface on the other side of the double adhesive tape may be used for holding coverup material, such as, for example, foil, paper, cardboard, etc. This material can be adhered by an easy pressure on the free adhesive surface. Since forces are transmitted by the cover-up material and the adhesive surface holding the cover-up material onto the other single adhesive tape glued via the joint overlapping area, a gluing free of grooves in two single jointed adhesive tapes is indispensible.

The surfaces that are to be covered usually are of variable size and have to be completely covered. However, the prior art, for example as disclosed in U.S. Pat. No. 3,950,214, as well as in U.S. Pat. No. 4,096,021 produces no hint for the solution of this problem, since in this prior art a cover-up paper of a paper roll with a different width is glued together with the single adhesive tape, so that apart from the difficulties in case of gluing the corners, only a cover-up of an area of the predetermined width of the paper may be achieved. Other prior art, for example, U.S. Pat. No. 3,042,104, U.S. Pat. No. 2,625,200, AT Pat. No. 25 10 65 and German Pat. No. 969 889, give no hint of the solution to this problem, since concern is with a different use.

The object of the present invention is a hand tool which is easy to handle, inexpensive, may be produced in a compact construction, and will fully join individual adhesive tapes.

A particular advantage of this invention lies in the deflecting devices for the adhesive tape and their arrangement between the supply rolls, a protected and yet at the same time easily accessible arrangement, whereby an intensive joint reversing surface achieves the desired intensive adhesion in the overlap area. Moreover, the handle opposite the output direction of the double adhesive tape makes possible a power saving and also neat handling of the instrument. For example, when working with hands soiled by paint, the instrument may be held in such a way that paint dripping from the fingers cannot drip into the area of the supply rolls and the arrangements for the deflection of the adhesive tape.

Figure 2:
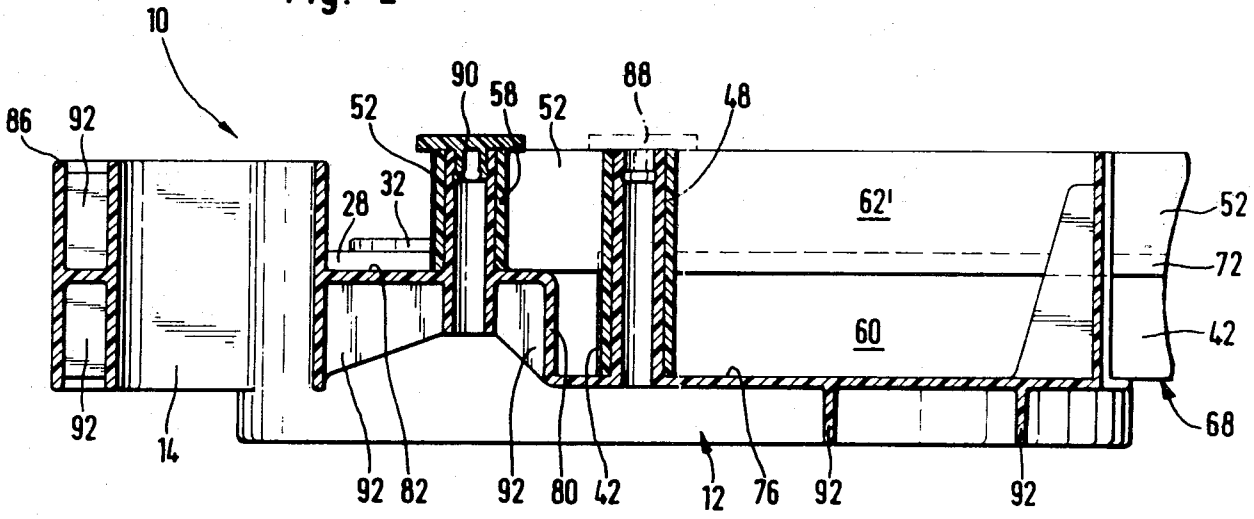

FIG. 1 shows a top view of an instrument with one supply roll and a steering arrangement of an adhesive tape; and FIG. 2 shows a sectional view along the line II—II in FIG. 1.

According to FIG. 1, apparatus 10 has a plastic, one-piece frame 12 of suitable color and shape which includes a handle 14 connecting to a first support 16 and a second support 18. A stabilizing bridge area 20 is provided between supports 16 and 18.

The first and second supports 16 and 18 each include a rotary spool 22 mounted for rotation about a first axis 24 for first support 16 and a second axis 26 for second support 18. Each spool 22 is developed as a pipe section which is molded in one piece to the frame 12 and has an outside diameter which approximately corresponds to the inside diameter of a supply roll for conventional single adhesive tapes. Thus, for example, a first supply roll 28 may be inserted onto first support 16 and a second supply roll 30 onto second support 18. As a result of the somewhat smaller outside diameter of the spools 22, as compared to the somewhat larger inside diameter of the supply rolls 28 and 30, the latter are rotabable around spools 22 about axes 24 and 26.

Rolls 28 and 30 may be secured with a lateral stop member 32 which fits on supports 16 and 18 while still permitting rotation thereof. Tabs 34 are provided on each spool 22 on the front surfaces of spools 22 for engagement with members 32 by way of corresponding slots 36 in member 32. Member 32 is located in place by twisting the supply rolls 28 or 30 so that tabs 34 penetrate into corresponding slit-shaped grooves 38, which are disposed on both sides of the recess 36, so that the tabs 34 may be clamped firmly in recesses 38. Preferably, at least three slots 36 with pertinent tabs 34 are provided for each member 32. In the member 32 gripping holes 40 are provided for the easier manual twisting in the peripheral direction of these rolls. Three fingers can be inserted into these recesses for quick mounting of member 32.

A first single adhesive tape 42 is guided from the first supply roll 28 in the direction of a corresponding stamping 42' to a first adhesive tape control 44 which includes a roll 48 rotatable around axis 46. At the same time the first single adhesive tape 42 contacts first roll 48 along a single tape reversing surface 50. Second single adhesive tape 52 is unwound from a second supply roll 30 and is guided via a second adhesive tape control 54 along a line guide 52' stamped into frame 12. Second adhesive tape control 54 likewise has an axis 56 around which a roll 58 is rotatably mounted. The second single adhesive tape 52 is guided around second roll 58 in the same manner as the first single adhesive tape 42 is guided around first roll 48, with adhesive sides 60 and 62 upwardly directed, whereby the second single adhesive tape 52 touches the second adhesive tape control 54 about a feed reversing surface 64. After leaving the feed reversing surface 64, the second single adhesive tape is guided to the first adhesive tape control 44 and meets the outside of first roller 48 in such a way that the adhesive surface 62 is directed radially inward toward the axis 46.

Since the axis of first supply roll 28 is displaced from second supply roll 30, but in the same plane, and since no slanting guidance takes place in relation to this plane, the first single adhesive tape 42 and the second single adhesive tape 52 meet on a cylindrical surface 66 of first roll 48 in such a way that the two single adhesive tapes 42 and 52 are glued together jointly by way of a reversing surface to form a double adhesive tape 68 which may be separated on a tear-of or cut-off device 70, depending on need.

FIG. 2 shows a section along the line II—II in FIG. 1. This view shows clearly the one-piece development of the instrument 10, which has a handle 14 on one side which is disposed in the opposite direction to the pull-out direction of the double adhesive tape 68. The double adhesive tape 68 of the first single adhesive tape roll 42 and the second single adhesive tape 52 can be seen clearly in this illustration with an overlap area 72, whereby the finished double adhesive tape 68 leaves the first adhesive tape control arrangement 44 after the joint reversing surface 66 on a tangential contact line 74. The double adhesive tape 68 is controlled on one side by a first lateral stop surface 76. Stop surface 76 is in a plane on which the first supply roll 28 also rests and thus is laterally limited. This first lateral stop surface 76 for the first supply roll 28 extends beyond the entire support surface of the first supply roll 28 up to an edge 78 which at the same time protects the first single adhesive tape 42 and provides a stabilizing function for the entire instrument 10. Furthermore, the first lateral stop surface 76 extends into the area of the first adhesive tape control 44 which is disposed vertically to the stop surface. Furthermore, lateral stop surface 76 has the above explained stamping 42' for guiding first single adhesive tape 42 and on a margin directed outwardly, tear-off or cut-off apparatus 70. Between the first control 44 for the adhesive tape and the second control 54 for the adhesive tape, a stop 80 leads from the first lateral stop surface 76 to a second lateral stop surface 82 on which the second supply roll 30 rests and on which the second adhesive tape control 54 is disposed vertically. The first lateral stop surface 82 for the second supply roll 30 is likewise reinforced with a housing-shaped stabilizing edge 84 which, like stabilizing edge 78, passes over into a corresponding stabilizing edge 86 on the handle 14.

In the case of the first adhesive tape control 44, the steering roll 48 is limited by the first lateral stop surface 76 for the first supply roll 28 on the one side and by a releasable, second lateral stop surface 88 on the other side so that roll 48 is rotatable between these lateral stop surfaces. Likewise, in the case of the second adhesive tape control 54, roll 58 is limited by the first lateral stop surface 82 for the second supply roll 30 on the one side and a corresponding second lateral stop surface 90 on the other side. Thus, the second lateral stop surface 90 is also releasably connected with adhesive tape control 54. This means that, apart from the two lateral stop surfaces 32 for the first supply roll 28, or the second supply roll 30 and the two second lateral stop surfaces 88 or 90, for the corresponding rolls 48 and 58 of the first adhesive tape control 44, or the second adhesive tape control 54, the entire device 10 is developed in one piece and thus may be handled without breakage. This one-piece device is further stabilized by corresponding reinforcing bridges 92, so that even in the case of manual working, hard thrusts and strokes will permit a solid method of operation without fear of destruction or damage.

In order to make the instrument operative, in the beginning all that is required is an insertion of the proper supply rolls 28 and 30 with pertinent adhesive sides 60 and 62 or reverse sides 60' and 62' for which purpose the safety plate 32 may be released by a simple turn by way of the gripping or finger recesses 40. After insertion of the supply rolls 28 or 30, the members 32 are put on again, just as simply, and are twisted in the direction of the periphery with the corresponding grip recesses 40 until tabs 34 will bring about a clamping connection in the grooves. This means that the supply rolls 28 and 30 may be inserted or exchanged within seconds. The first single adhesive tape 42 projecting from the supply roll 28 is guided right around the first adhesive tape control 44 to the tear-off device 70 without at the same time there being any need for paying attention to a precise course of the first single adhesive tape 42. Likewise, the free end of the second single adhesive tape 52 is drawn around the second adhesive tape steering control 54 and is pulled off between the first adhesive tape steering control 44 and through the second adhesive tape steering control 54, past the first adhesive tape steering control 44 likewise to the tearing off device 70, without there being any need for paying attention to a precise course of the tape. By pulling up the second single adhesive tape 52, a gluing together with the first single adhesive tape 42 occurs at the same time automatically so that the latter, during pulling out in the direction of the tearing-off device 70, is already driven. At the latest after pulling out a few centimeters of the adhesive tapes brought together at first imprecisely, the gluing to a double adhesive tape 68 stabilizes so that a uniform overlap area 72 develops to produce a uniform quality of the double adhesive tape 68. This will be achieved advantageously by the adhesive tape controls 44 and 45 disposed centrally between the two supply rolls 28 and 30 which controls 44 and 54 are disposed in alignment one behind the other in the direction of pulling out so that their axes 46 and 56 lie in one plane.

Naturally, other arrangements, too, for the first adhesive tape control 44 and the second adhesive tape steering control 54 may be made by displacing these in their axial arrangement as well as in their spatial planes of supply, without there being any need thereby to change the main idea of the invention. It is also conceivable to adjust variable thicknesses of the tape of the single adhesive tape by corresponding support discs in the case of the first supply roll 28 or lay on discs in the case of the second supply roll 30. It is also possible to develop the second lateral stop surfaces not only separately but also jointly so that, for example, a continuous cover-up will also develop in an upward direction, whenever this is desired. As compared to the continuous cover-up form, a half-open construction has the advantage of easy accessibility for purposes of cleaning and cleaning liquids, and a quick, uncomplicated control of the pertinent supply on the first and second supply roll 28 and 30 is possible. The gripping area can be developed such that a part of the interval formed by the two supply rolls may be used also for the gripping area of the handle 14.

Furthermore, one peculiarity of the present invention is that the entire instrument may be produced from the same and/or identically colored working material, whereby even the rollers 48 and 58 of the first adhesive tape control 44 or of the second adhesive tape control 54 may be produced from the same working material.

This working material preferably is a plastic with a very smooth surface so that especially the forces of adhesion of the second single adhesive tape 52 may be kept low on the roll 58. This will become possible also through the fact that the double, single adhesive tape thickness absorbs the main traction forces merely in the overlap area 72, as a result of which an intensive gluing together of the two single adhesive tapes 42 and 52 takes place in the overlap area 72, while the remaining surfaces—that is to say those which remain free—of the single adhesive tape 42 or of the second single adhesive tape 52 are guided around the joint reversing surface 66 only in a single thickness of the tape, so that as a result the traction forces acting on the joint double adhesive tape 68 have an effect less than in the overlap area 72 on the remaining surfaces of the single adhesive tape. Thus, the adhesive surface of the second single adhesive tape 52 on the joint reversing surface also can remain slight and there is prevented an intensive gluing to the joint reversing surface 66. Thus, it is not necessary to limit to a tangential contact line 74 with the known disadvantage thereof.

Many changes and modifications can of course be carried out without departing from the scope of the present invention, that scope being intended to be limited only by the scope of the appended claims.

What is claimed is:

1. A device for joining two adhesive tapes each having one adhesive side into a centrally overlapping double adhesive tape with the adhesive sides on either side of the overlapping area facing in opposite directions comprising:

two supports for each rotatably mounting one supply roll of rolled-up single adhesive tape around a rotary core;

a frame mounting and connecting the rotary cores with their axes displaced from one another in mutually corresponding radial planes and having a handle portion; and means located between said supports for joining said tape including first and second adhesive tape control cylindrical rolls, one of the single adhesive tapes being unrolled from one supply roll around one of said rolls, and then steered into position about the other of said rolls with its adhesive side in contact with the adhesive side of the other single adhesive tape in such a way that a double adhesive tape is formed which is partially adhesive on both sides, and drawn out with a glued together overlap area through an area bounded by stops on either side, the cylindrical surface of said other roll extending beyond a tangential contact line at which said tape is drawn from said other roll so that said tape can be pulled off said cylindrical surface in a direction which can be varied between said stops.

2. A device as in claim 1, wherein the axis of the second adhesive tape control roll is substantially disposed in a vertical plane containing the axis of the first adhesive tape control roll.

3. A device as in claim 2, wherein said first and second adhesive tape controls are disposed centrally between the supply rolls.

4. A device as in claim 1, wherein the first and second adhesive tape control rolls each have at least one lateral stop surface for the guiding of the single adhesive tapes.

5. A device as in claim 4, wherein each lateral stop surface is also a lateral stop surface for a supply roll.

6. A device as in claim 4 or 5, wherein a second, lateral stop surface is provided on each adhesive tape control roll.

7. A device as in claim 6, wherein the second, lateral stop surface of the first and second adhesive tape control roll lie in one plane.

8. A device as in claim 7, wherein the second lateral stop surfaces are developed to be releasable.

9. A device as in claim 8, wherein the second, lateral stop surfaces for the supply rolls have recesses.

10. A device as in claim 9, wherein at least one support is developed as an at least partially closed supply container for the supply rolls.

11. A device as in claim 10, wherein the frame includes a handle disposed opposite to the point of exit of the double edged tape.

12. A device as in claim 11, further including means for tearing the double adhesive tape.

* * * * *